US009016356B2

(12) United States Patent
Hollweck

(10) Patent No.: US 9,016,356 B2
(45) Date of Patent: Apr. 28, 2015

(54) COOLING DEVICE FOR ENGINE AND/OR TRANSMISSION OIL, IN PARTICULAR OF AN INTERNAL COMBUSTION ENGINE

(75) Inventor: Johannes Hollweck, Sulzbach-Rosenberg (DE)

(73) Assignee: MAN Truck & Bus AG, Munich (DE)

( * ) Notice: Subject to any disclaimer, the term of this patent is extended or adjusted under 35 U.S.C. 154(b) by 596 days.

(21) Appl. No.: 12/868,328

(22) Filed: Aug. 25, 2010

(65) Prior Publication Data

US 2010/0319638 A1 Dec. 23, 2010

Related U.S. Application Data

(63) Continuation of application No. PCT/EP2010/001053, filed on Feb. 19, 2010.

(30) Foreign Application Priority Data

Feb. 25, 2009 (DE) ..... 10 2009 010 486
Dec. 3, 2009 (EP) ..... 09014979

(51) Int. Cl.
*F01N 5/02* (2006.01)
*F28D 7/10* (2006.01)
(Continued)

(52) U.S. Cl.
CPC ..... *F01M 5/002* (2013.01); *F01M 11/0004* (2013.01); *F01M 2011/0025* (2013.01); *F01P 11/08* (2013.01); *Y10S 165/916* (2013.01)

(58) Field of Classification Search
USPC ..... 165/51, 119, 157, 158, 167, 916, 72, 165/73, 74; 123/196 AB; 184/104.2, 104.3
See application file for complete search history.

(56) References Cited

U.S. PATENT DOCUMENTS 2,782,008 A * 2/1957 Caughill ..... 165/67
4,150,655 A 4/1979 Gaggiano et al.
(Continued)

FOREIGN PATENT DOCUMENTS

DE 196 19 977 A1 12/1997
DE 19930805 A1 * 1/2001
(Continued)

OTHER PUBLICATIONS

DE 19930805 A1 description translation.*
(Continued)

*Primary Examiner* — Allen Flanigan
*Assistant Examiner* — Jon T Schermerhorn
(74) *Attorney, Agent, or Firm* — Laurence A. Greenberg; Werner H. Stemer; Ralph E. Locher

(57) ABSTRACT

A cooling device for engine oil and/or transmission fluid, in particular of an internal combustion engine, has a flow-through oil cooler in an oil trough. The oil cooler is formed by a plate heat exchanger with plate intermediate spaces which route coolant and oil. The plate intermediate spaces that conduct oil have an outer opening region which is arranged on the outer circumference of the plate heat exchanger as inflow region, via which hot oil to be cooled flows into the oil-conducting plate intermediate spaces. Furthermore, the oil-conducting plate intermediate spaces have an outer outflow region which is arranged on the outer circumference of the plate heat exchanger at a distance from the inflow region. The outflow region is connected indirectly or directly to an outer oil line connecting region, via which cooled oil flows out after heat exchange with the coolant. The plate heat exchanger is suspended in the oil trough at a defined spacing from the oil trough walls which surround it.

13 Claims, 7 Drawing Sheets

(51) Int. Cl.

| | |
|---|---|
| ***F28F 3/08*** | (2006.01) |
| ***F01M 5/00*** | (2006.01) |
| ***F01M 11/00*** | (2006.01) |
| ***F01P 11/08*** | (2006.01) |

(56) References Cited

U.S. PATENT DOCUMENTS

| | | | | | |
|---|---|---|---|---|---|
| 4,519,449 | A | * | 5/1985 | Hoskins et al. | 165/141 |
| 4,538,679 | A | * | 9/1985 | Hoskins et al. | 165/178 |
| 4,831,980 | A | | 5/1989 | Nasu et al. | |
| 4,878,536 | A | | 11/1989 | Stenlund | |
| 5,165,468 | A | * | 11/1992 | Tajima et al. | 165/47 |
| 5,934,241 | A | * | 8/1999 | Von Esebeck et al. | 123/196 R |
| 7,055,405 | B1 | * | 6/2006 | Nitsche | 74/606 A |
| 7,637,337 | B2 | | 12/2009 | Stranges | |
| 2007/0000639 | A1 | * | 1/2007 | Ozawa et al. | 165/41 |

FOREIGN PATENT DOCUMENTS

| | | | |
|---|---|---|---|
| DE | 10 2004 036 286 | A1 | 3/2005 |
| EP | 0 691 462 | A1 | 1/1996 |
| EP | 1 600 611 | A1 | 11/2005 |
| FR | 2 367 921 | | 5/1978 |
| GB | 2 352 806 | A | 2/2001 |
| WO | 88/06228 | A1 | 8/1988 |
| WO | 0028269 | A1 | 5/2000 |

OTHER PUBLICATIONS

DE 19930805 A1 claims translation.*

* cited by examiner

COOLING DEVICE FOR ENGINE AND/OR TRANSMISSION OIL, IN PARTICULAR OF AN INTERNAL COMBUSTION ENGINE

CROSS-REFERENCE TO RELATED APPLICATION

This application is a continuation, under 35 U.S.C. §120, of copending international application No. PCT/EP2010/001053, filed Feb. 19, 2010, which designated the United States; this application also claims the priority, under 35 U.S.C. §119, of German patent application No. DE 10 2009 010 486.0, filed Feb. 25, 2009, and European patent application No. EP 09014979.0, filed Dec. 3, 2009; the prior applications are herewith incorporated by reference in their entirety.

BACKGROUND OF THE INVENTION

Field of the Invention

The invention relates to a cooling device for engine and/or transmission oil, in particular to a cooling device for engine and/or transmission oil of an internal combustion engine. The cooling device has an oil cooler which is arranged in an oil trough and through which a coolant flows.

It is generally known that a cooling device of this type for engine and/or transmission fluid is attached to an engine or transmission housing. Here, both the coolant and the medium to be cooled have to be led to the cooling device and away from the cooling device. A cooler of this type requires a relatively large amount of installation space.

It is already known from German published patent application DE 10 2004 036 286 A1 to provide an oil cooling device for an engine, in which oil cooling device an oil cooler is arranged within an oil trough at a spacing from a floor surface. Furthermore, an oil intake opening is arranged here below the oil cooler and spaced apart from the latter. A construction of this type is intended to improve the degree of circulating efficiency of the oil in the oil trough, which in turn is intended to have a positive effect on the degree of efficiency of the oil cooling itself.

European patent EP 1 600 611 B1 describes a construction of an oil trough for an engine and/or a transmission. The bottom-side opening of the oil trough is closed by a cover. The cover comprises a heat exchanger for the oil which has a coolant inlet, a coolant outlet and coolant channels lying fluidically between them.

U.S. Pat. No. 5,934,241 and its counterpart German published patent application DE 196 19 977 A1 describe an internal combustion engine with an oil trough, in the housing of which oil channels are formed. Here, the cooling device which is formed by a plate heat exchanger is seated outside the oil trough here.

Furthermore, German patent DD 39 500 describes a cooling device for an oil trough, in which a cooling channel is routed in the form of a helix from an outer inflow opening as far as a suction space of the oil pump, which suction space lies approximately in the center of the oil trough. Oil which is discharged via a pressure relief valve is guided out of the pressure line of the oil pump through a preferably nozzle-shaped opening under the oil level, approximately horizontally into the oil layer via the oil channel.

A further oil cooling device is also known from German patent DD 85 686, in which the cooling circuit of the engine is connected to the lower cover of the engine and is fastened to the oil trough, a pump screen of the oil pump being arranged in the oil trough base which is separated from the lower cover by a dividing wall. Furthermore, the passage channels for the throughflow of the cooling fluid are formed in the cover and the passage channels for the passage of the lubricating oil are formed in the base by the ribs.

U.S. Pat. No. 2,782,008 describes a complicated, base-side arrangement of a plate heat exchanger, in which the individual plates are welded or are arranged and fastened on the oil trough side in connection with spacer and spacing elements.

SUMMARY OF THE INVENTION

It is accordingly an object of the invention to provide a cooling device for engine oil and/or transmission fluid which overcomes the above-mentioned disadvantages of the heretofore-known devices and methods of this general type and which provides for a cooling device that is particularly suited for an internal combustion engine, and by means of which cooling device the oil cooling can be carried out in a simple way in terms of components and with high efficiency.

With the foregoing and other objects in view there is provided, in accordance with the invention, a cooling device for engine and/or transmission oil cycling through an oil trough formed with oil trough walls, the cooling device comprising:

- a plate heat exchanger forming an oil cooler in the oil trough, the plate heat exchanger being suspended in the oil trough at a defined spacing from the oil trough walls surrounding the plate heat exchanger;
- the plate heat exchanger having plates disposed to form first plate intermediate spaces therebetween conducting a coolant flow therethrough and second plate intermediate spaces conducting the oil therethrough;
- the second plate intermediate spaces having an outer opening region on an outer circumference of the plate heat exchanger, forming an inflow region for hot oil to be cooled to flow into the second plate intermediate spaces; and
- the second plate intermediate spaces having an outer outflow region on the outer circumference of the plate heat exchanger distally from the inflow region and connected indirectly or directly to an outer oil line connection, for cooled oil to flow out after traversing the second plate intermediate spaces and after exchanging heat with the coolant.

In other words, the cooling device has an oil cooler which is arranged in an oil trough and through which a coolant flows, the oil cooler being formed by a plate heat exchanger with plate intermediate spaces which route coolant and oil, and the plate intermediate spaces which route oil having an outer opening region which is arranged on the outer circumference of the plate heat exchanger as inflow region, via which hot oil to be cooled flows into the plate intermediate spaces which route oil. Furthermore, the plate intermediate spaces which route oil have an outer outflow region which is arranged on the outer circumference of the plate heat exchanger at a distance from the inflow region and is connected indirectly or directly to an outer oil line connecting region, via which cooled oil flows out after flowing through the plate intermediate spaces which route oil and therefore after exchanging heat with the coolant. According to the invention, the plate heat exchanger is suspended in the oil trough in such a way that it is at a defined spacing from the oil trough base wall and from the oil trough side walls.

The cooling device is particularly suited for cooling the transmission fluid and/or the engine oil of an internal combustion engine.

A plate heat exchanger or plate heat transmitter of this type makes a construction of the cooling device possible which is simple overall, it being possible for the oil to be cooled in an effective and efficient way. In particular, the option that the oil can flow into the heat exchanger directly via the respective plate intermediate spaces which route oil makes oil cooling with a high degree of efficiency possible, in conjunction with the relatively long flow paths in a plate heat exchanger.

A further particular advantage of this construction lies in the fact that a relatively large amount of cooling surface area can be provided by the integration of the plate heat exchanger into the oil trough, which is often not the case on account of the constricted installation space in heat exchangers or coolers which are arranged on the outside.

According to one particularly preferred refinement of the present inventive concept, a particular efficient dissipation of heat in conjunction with long flow paths results when the outer inflow region and the outer outflow region lie on opposite sides of the plate heat exchanger, as viewed in cross section through the plate heat exchanger.

There is provision according to a further particularly preferred refinement of the present inventive concept for the plate heat exchanger to have a plate assembly comprising a plurality of plates, the plate assembly being arranged in a heat exchanger housing which, on the side of the inflow region, has an oil inlet opening, via which oil flows out of the oil trough into the heat exchanger housing, and which heat exchanger housing has, on the outflow side, an oil outlet opening, via which oil flows out of the heat exchanger housing. By way of an encapsulated solution of this kind, the plate heat exchanger can be fixed on the oil trough side in a simple way via, for example, housing-side fastening elements, and particularly favorable flow conditions are achieved, which has a particularly advantageous effect on the degree of efficiency of the heat transfer in the plate heat exchanger. The latter also applies, in particular, for the case where, as is proposed according to a further particularly preferred refinement, an inflow chamber, into which the oil flows via the oil inlet opening, is connected in front of the inflow region of the plate assembly in the heat exchanger housing. The oil inlet opening is preferably arranged to lie geodesically deeper than the plate heat exchanger or the plate assembly, an inflow preferably taking place from below, in relation to the mounted state. A filter and/or screen element, by way of which the inflow of contaminants can advantageously be avoided, is preferably arranged on the side of the inflow region, in particular in the region of the oil inlet opening.

Furthermore, an inflow chamber of this type ensures in a simple way that identical inflow conditions prevail substantially over the entire plate assembly in relation to the oil which flows into the respective plate intermediate spaces which route oil. The same applies analogously with regard to the outflow conditions for a further preferred refinement, according to which an outflow chamber, into which the oil flows after flowing through the plate intermediate spaces which route oil and the oil outlet opening of which outflow chamber forms an oil line connecting region, is connected behind the outflow region of the plate assembly in the heat exchanger housing.

According to a further preferred refinement, an oil line can be connected at the oil line connecting region or else is connected integrally to the latter. The oil line itself is preferably formed by a suction pipe line on the oil pump side, with the result that the intake pressure can be applied via this suction pipe line to the oil in the oil trough, in order to suck in the oil via the plate intermediate spaces which route oil and open into the oil trough or via their opening regions which form the inflow region into the plate heat exchanger.

One refinement and arrangement of the cooling device is particularly preferred, in which the plate heat exchanger is arranged and/or suspended in the oil trough at a defined spacing from at least one part of the base and/or side walls on the oil trough side which surround it. The degrees of heat exchanging efficiency which are most favorable for the respective application can be achieved in this way. The plate heat exchanger is particularly preferably fixed by means of heat exchanger bearing elements on supports on the housing wall side and/or attachment points on the housing wall side and/or directly on the housing wall. In particular, releasable fastening means, for example screws, are provided as fastening means, which are preferably arranged in such a way that they are accessible very satisfactorily and easily from an oil trough opening for mounting.

The heat exchanger bearing elements can be configured in principle in very different ways. One refinement is particularly preferred, in which the at least one heat exchanger bearing element is formed by an insert plate or a yoke plate. Here, a yoke plate is understood to be a component which is designed, for example, in the manner of a latticework frame, as is described, for example, in European published patent application EP 0 691 462 A1, and which can reinforce the construction of the internal combustion engine in conjunction with a reduction in oscillations. In principle, however, the at least one heat exchanger bearing element can also be formed by an insert plate which in turn is integrated into the yoke plate or is connected to the latter. The plate heat exchanger can be arranged or suspended in the oil trough in a simple, functionally reliable and desired way by way of an insert plate of this type or, in particular, by way of a yoke plate of this type. In particular in conjunction with the yoke plate, this results in a functional integration by virtue of the fact that a component which is optionally already installed in any case on the oil trough side is used in a double function at the same time also as a holding element or bearing element for the plate heat exchanger.

According to one particularly preferred refinement, the plate heat exchanger is supported and/or clamped with its at least one heat exchanger bearing element between two or more oil trough housing walls, in particular between two oil trough housing walls which lie opposite one another, with the result that the plate heat exchanger forms, for example, a type of pulling element here. As a result, the oil trough side walls are supported against one another, which considerably reduces oscillation of the side walls and therefore leads to a reduction in noise.

For a particularly high functional integration, it is proposed to integrate coolant channels into the at least one heat exchanger bearing element, for example into the yoke or insert plate. The coolant channels are flow-connected to at least one part of the plate intermediate spaces which route coolant. According to a further particularly preferred refinement of the present invention, the coolant channels which are flow-connected to the plate intermediate spaces which route coolant are formed by coolant channels which are integrated at least partially into a housing wall of the oil trough. One refinement is particularly preferred, according to which the two above-described embodiments are combined with one another, namely in such a way that the coolant channels which are integrated into the at least one heat exchanger bearing element are flow-connected to the coolant channels which are integrated into the housing wall. Here, the coolant channels are preferably formed by a plurality of bores which communicate with one another and are simple and inexpensive to produce.

Other features which are considered as characteristic for the invention are set forth in the appended claims.

Although the invention is illustrated and described herein as embodied in a cooling device for engine and/or transmission oil, in particular of an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
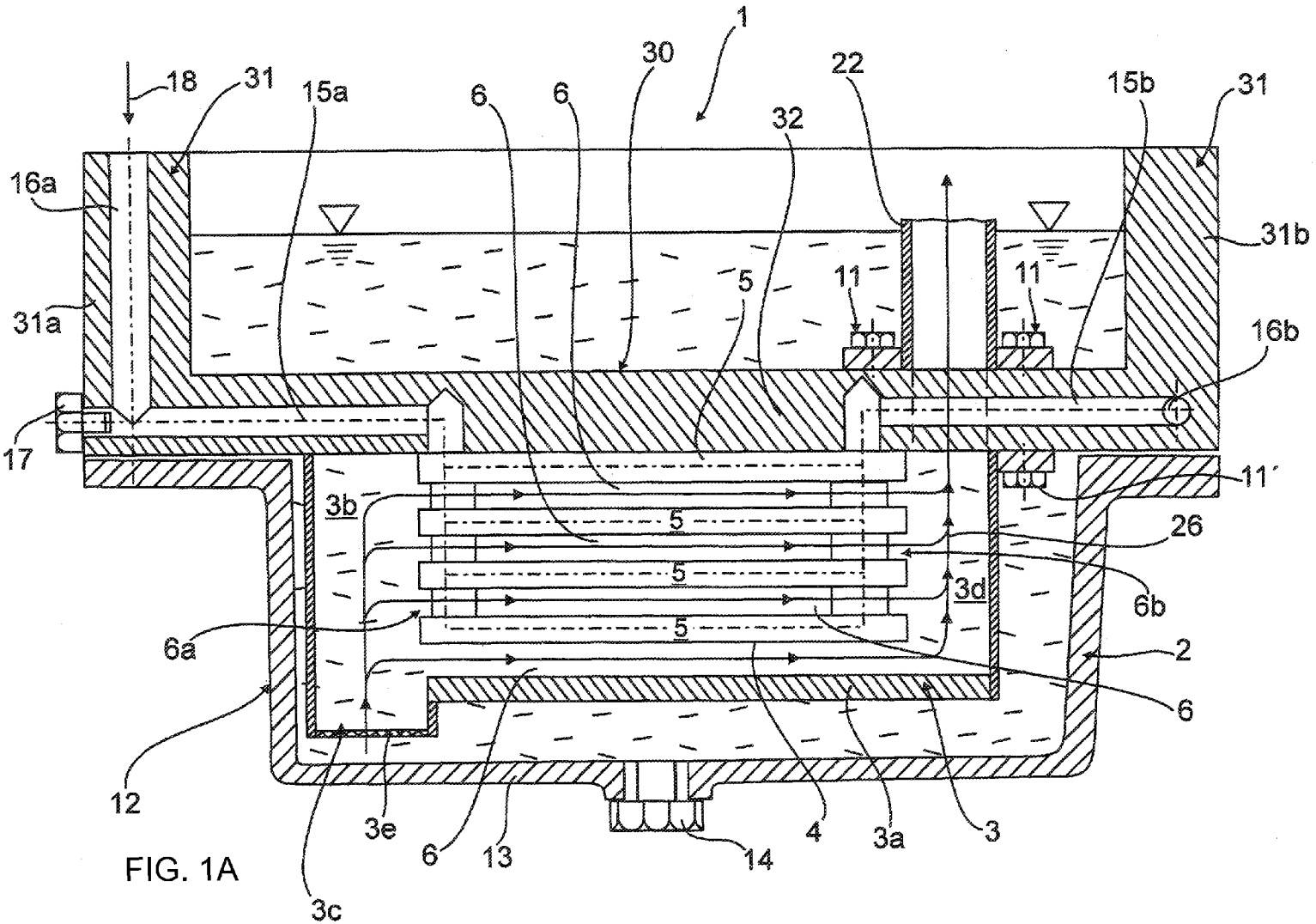
FIG. 1A diagrammatically shows a cross section through an oil trough with a cooling device according to the invention.

Referring now to the figures of the drawing in detail and first, particularly, to FIG. 1A thereof, there is shown a diagrammatic, cross-sectional view through a first exemplary embodiment of a cooling device 1 according to the invention. The cooling device 1 comprises a plate heat exchanger 3 which is received and arranged in an oil trough 2 as oil cooler.

The plate heat exchanger 3, more specifically, is formed with a plate assembly comprising a plurality of flat plates 4 which form first plate intermediate spaces 5 which guide coolant and second plate intermediate spaces 6 which guide oil.

Here, the second plate intermediate spaces 6 which route oil open by way of an outer inflow region 6*a* into the oil trough 2 or a prechamber 3*b* of a housing 3*a* of the plate heat exchanger 3, which housing 3*a* surrounds the plate assembly. The prechamber 3*b* opens into the oil trough by way of an inlet opening 3*c* which is formed here in the manner of a nozzle, with the result that oil is sucked out of the oil trough 2 into the prechamber 3*b* via the inlet opening 3*c* which extends, for example, in a slot-like manner into the plane of the image or extends out of the plane of the image, and the oil can be subsequently sucked via the outer inflow region 6*a* into the plate intermediate spaces 6 which route oil. A filter and/or screen element 3*e* is preferably arranged, for example inserted or pushed on, in the region of this inlet opening 3*c*, by means of which filter and/or screen element 3*e* contaminants, such as metal parts or the like, are retained and remain in the oil trough 2.

An outflow chamber 3*d*, into which an outer outflow region 6*b* of the oil-conducting, second plate intermediate spaces 6 opens, is formed in the housing 3*a* on the opposite side of the plate assembly. Here, the oil to be cooled therefore flows in and out on opposite sides of the plate heat exchanger 3, in relation to the cross section through the plate heat exchanger 3, as a result of which a very long flow path through the plate heat exchanger 3 is achieved and provided. On the sides which lie opposite one another in the direction into the plane of the image or out of the plane of the image, the plate assembly of the plate heat exchanger 3 is encapsulated by, for example, the housing 3*a* in a manner which is not shown here, with the result that no oil can flow into or out of the plate intermediate spaces 6 which route oil via these sides of the plate heat exchanger 3 which lie opposite one another in the direction into or out of the plane of the image. That is to say therefore, in other words, that the oil to be cooled can flow into the plate intermediate spaces 6 which route oil only in the region of the outer inflow region 6*a* and can flow out of the plate intermediate spaces 6 which route oil only in the region of the outer outflow region 6*b*.

The individual plates 4 of the plate assembly can be mounted or secured here, for example, on the walls of the heat exchanger housing 3*a*.

The plate heat exchanger 3 itself is preferably secured by means of the heat exchanger housing 3*a* on a yoke plate 30 which forms a bearing element on the heat exchanger side, in such a way that the plate heat exchanger 3 is spaced apart both from the side walls 12 and from the base wall 13, in which an oil outlet screw 14 is usually arranged. The yoke plate 30 is connected fixedly, for example, to the oil trough 2, for example by means of screw connections, and has a yoke plate frame 31 which is circumferential on the edge side, the yoke plate frame sides 31*a* and 31*b* which lie opposite one another having, between them, a plurality of transverse webs 32 which are spaced apart from one another in the direction into the plane of the image or out of the plane of the image. That is therefore to say that the yoke plate 30 has an approximately ladder-like design, in which the individual transverse webs 32 form the ladder rungs.

In concrete terms here with respect to the example, the plate heat exchanger 3 is fixed to defined points of the yoke plate 30 by means of screw connections 11' which are shown here only extremely diagrammatically.

Coolant channels 15*a*, 15*b* which are produced by, for example, simple drilled holes and in turn communicate with coolant channels 16*a*, 16*b* which are formed in the yoke plate frame sides 31*a*, 31*b* can then be integrated into the transverse webs 32. In order to seal the coolant channels 15*a*, 16*a*, closure plugs or closure screws 17 can be inserted into them, as is shown merely extremely diagrammatically and by way of example in FIG. 1A. As is shown in FIG. 1A using dash-dotted lines, coolant can flow, at the location where the arrow 18 is drawn, into the coolant channel 16*a* on the yoke plate frame side, from where it passes via the coolant channel 15*a* on the transverse web side into the plate intermediate spaces 5 which route coolant, before the coolant flows out via the further coolant channel 15*b* on the transverse web side and the coolant channel 16*b* on the yoke plate frame side. Here, as can be seen from FIG. 1A, the coolant channels 16*a* and 16*b* are of different configuration, in order to show that not only coolant channels which extend vertically in relation to the plane of the image can be formed in the region of the yoke plate 30, but also coolant channels which extend horizontally, depending on the respective installation situations.

It goes without saying that only the plate intermediate spaces 6 which route oil are flow-connected to oil 25 in the oil trough 2. That is to say, the coolant side and the oil side are separated sealingly from one another and only a thermal transfer takes place between the two media. Furthermore, it goes without saying that the first plate intermediate spaces 5 which route coolant are of course flow-connected to one another, in order to ensure that a corresponding coolant flow flows through all the first plate intermediate spaces 5.

As can be further gathered from FIG. 1A, a suction pipe line 22 which is guided to an oil pump (not shown here) is connected to the outflow chamber 3*d* which has or forms an outlet opening. This suction pipe line 22 is fixed on the yoke plate side, for example, by means of the screw connection 11 which is shown merely diagrammatically here. Furthermore, it goes without saying that the coolant circuit is also connected to a pump which pumps the coolant in the circuit.

During operation of the cooling device 1, oil is therefore sucked out of the oil trough 2 into the prechamber 3 and further via the outer inflow region 6*a* into the plate heat exchanger 3 or into its plate intermediate spaces 6 which route oil, with the result that the oil subsequently flows along the entire length of the plate heat exchanger 3 and a heat transfer occurs there with the coolant in the plate intermediate spaces 5 which route coolant. The oil flow is shown diagrammatically here by way of the arrows 26.

After the cooled oil has flowed out via the outer outflow region 6*b* into the outflow chamber 3*b*, the cooled oil is extracted via the suction pipe line 22.

Figure 1B:
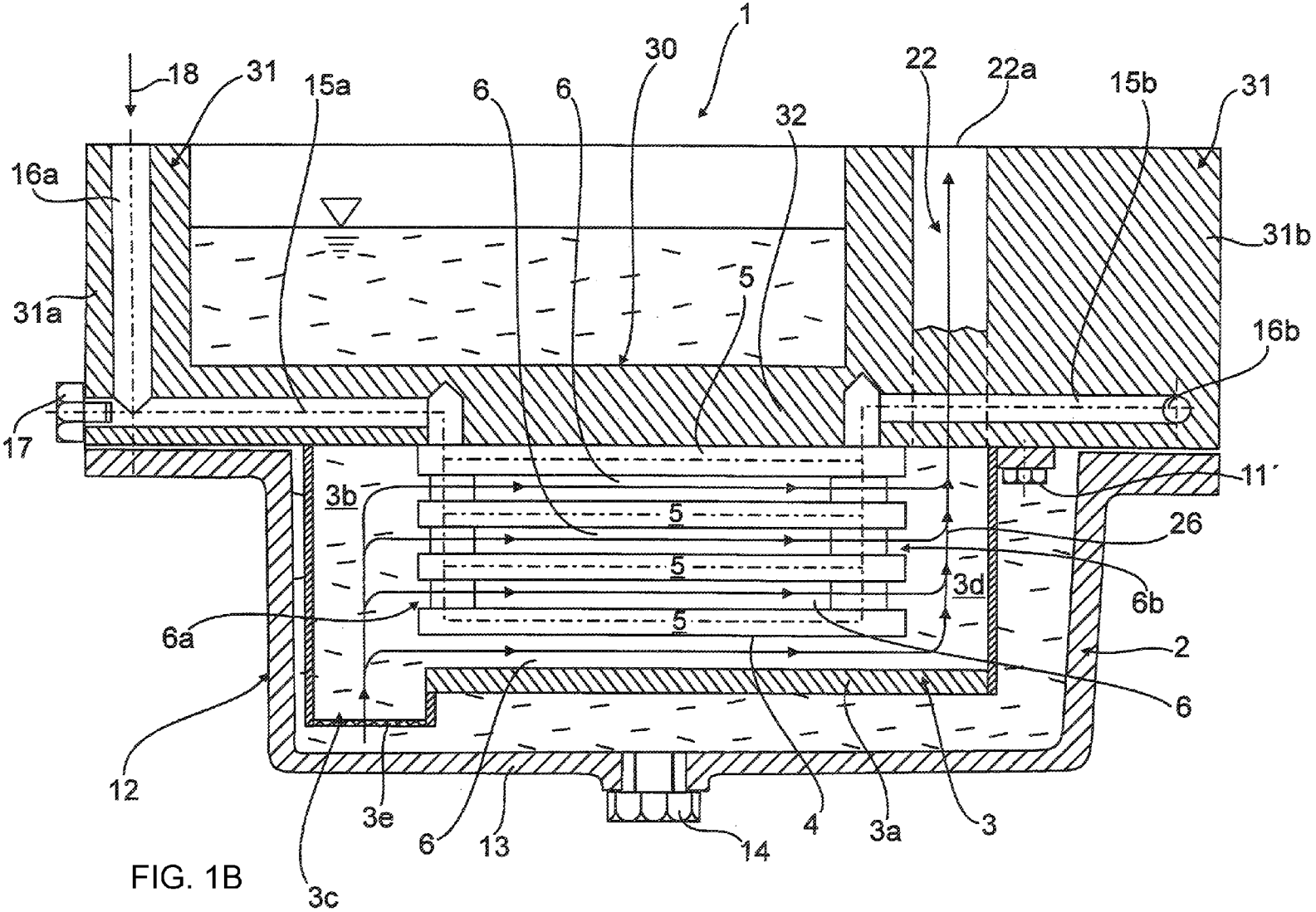
FIG. 1B shows an alternative refinement to FIG. 1A with a suction pipe line which is integrated into the yoke plate frame.

FIG. 1B shows an alternative refinement to FIG. 1A, which alternative refinement differs from that of FIG. 1A in that the outflow channel which is configured, for example, as a suction pipe line 22 is then integrated directly here into the yoke plate frame 31. Here, a further line, for example, can be connected in the opening side region 22*a*. Here, the outlet opening which is integrated into the yoke plate frame 31 can be produced, for example, by a drilled hole or the like.

Figure 2A:
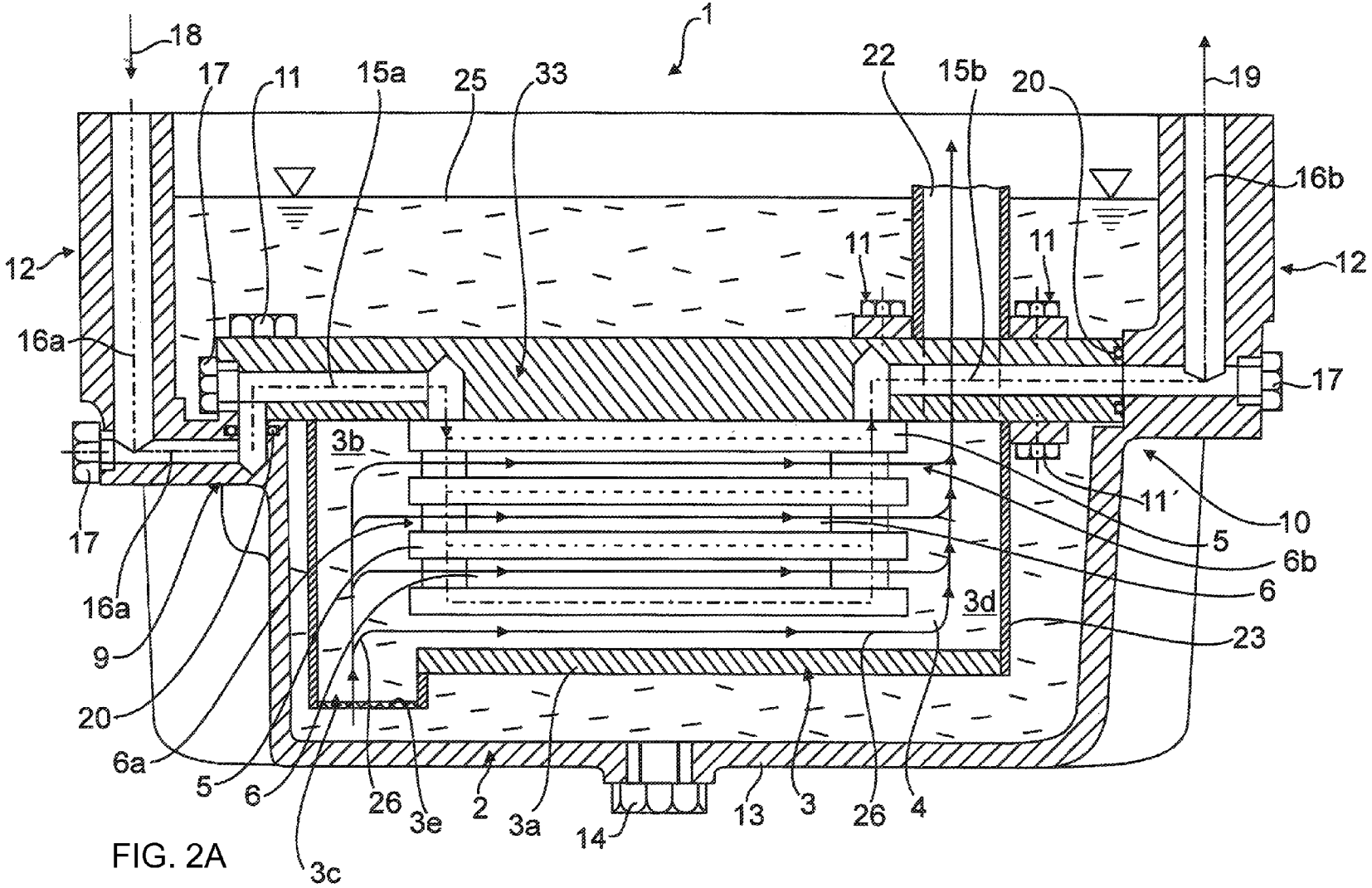
FIG. 2A diagrammatically shows a cross section through an oil trough with an alternative refinement of a cooling device according to the invention.

Finally, FIG. 2A shows a further alternative design variant to FIG. 1A, which alternative design variant corresponds to the design variant described above in conjunction with FIG. 1A, apart from the yoke plate 30. Here, in contrast to the yoke plate embodiment of FIG. 1A, the plate heat exchanger 3 is supported in such a way by means of an insert plate 30 on the heat exchanger side on trough side supports 9, 10 and is fixed, for example, by means of screw connections 11', that the plate heat exchanger 3 is spaced apart both from the side walls and from the base wall 13, in which an oil drain plug 14 is arranged in a customary way. Coolant channels 15*a*, 15*b* which are produced here by simple drilled holes are integrated into the insert plate 33, which coolant channels 15*a*, 15*b* in turn communicate with coolant channels 16*a*, 16*b* which are integrated into the housing wall of the oil trough 2 and are likewise produced by simple drilled holes. In order to seal the coolant channel parts which extend horizontally in relation to the plane of the image of FIG. 2A and open into the outer wall, closure plugs or closure screws 17 are inserted into them.

As is shown merely by dash-dotted lines in FIG. 2A, coolant can flow into the housing side coolant channel 16*a* at the location where the arrow 18 is drawn, from where it passes via the coolant channel 15*a* on the insert plate side into the plate intermediate spaces 5 which route coolant, before the coolant flows out according to the arrow 19 via the further cooling channel 15*b* on the insert plate side and the coolant channel 16*b* on the housing side.

In order to seal the coolant channels 15, 16 with respect to one another, sealing elements 20 are arranged between the insert plate 33 on one side and the housing side supports 9, 10 which are assigned to them.

Otherwise, the construction corresponds to that of FIG. 1A or also FIG. 1B.

Figure 2B:
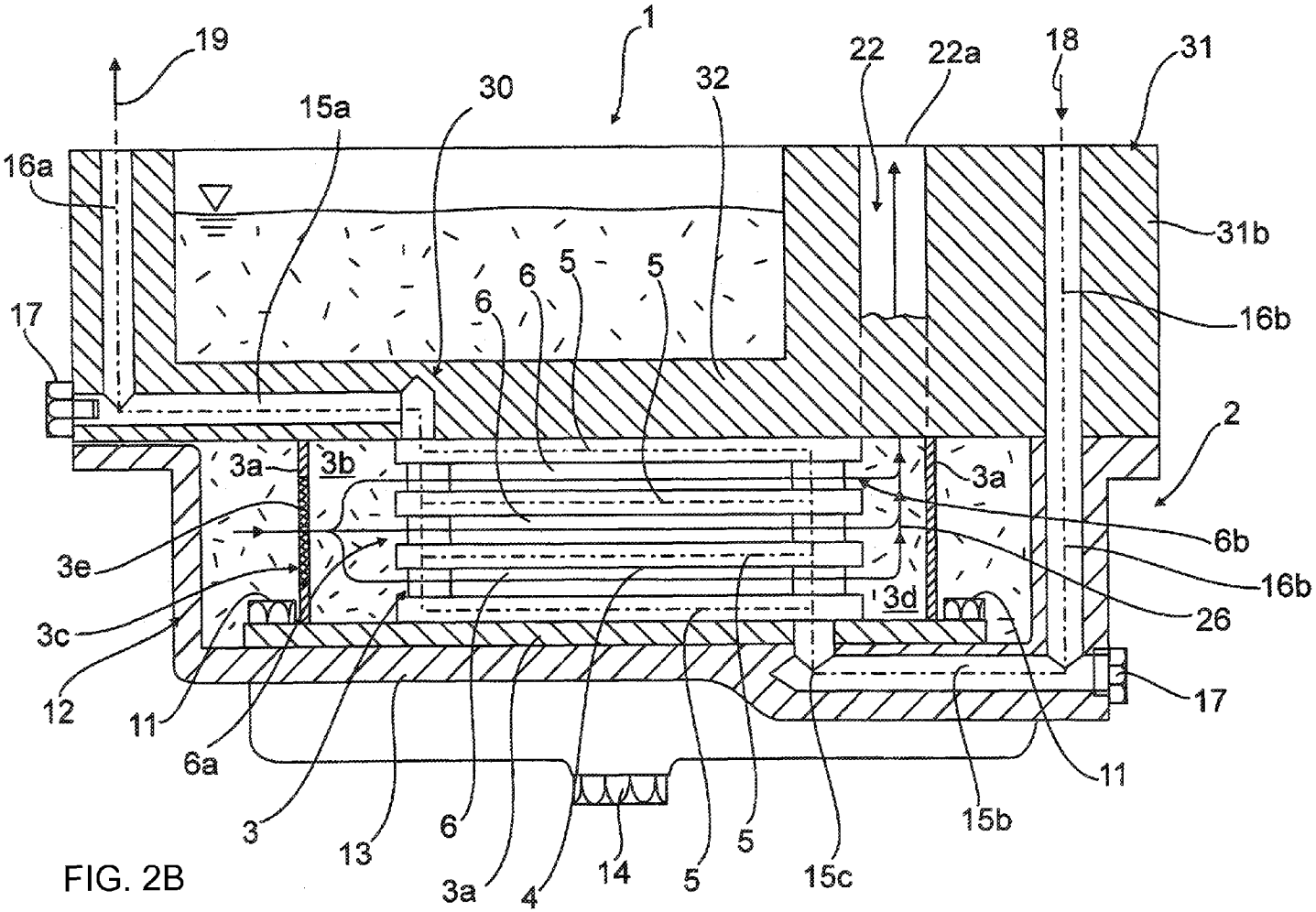
FIG. 2B diagrammatically shows a cross section through an alternative embodiment to the refinement according to FIG. 1B.

FIG. 2B shows a further alternative refinement which corresponds in substantial parts, in particular, to the refinement according to FIG. 1B, but with the difference that the plate heat exchanger 3 is fixed here to the base of the oil trough 2 by means of a base plate of the housing 3*a*, which is illustrated here merely extremely diagrammatically and by way of example by means of the two screw connections 11.

In a further difference to the refinement according to FIG. 1B, the coolant 18 is fed in here in the region of a coolant channel 16*b* in the yoke plate frame 31, which coolant channel 16*b* continues in the side wall 12 of the housing of the oil trough 2 and opens there into a horizontally extending transverse channel 15*b* which in turn is flow-connected to the plate intermediate spaces 5 which route coolant via a coolant channel 15*c* which projects vertically upward from it in the base plate of the housing 3*a* of the plate heat exchanger 3 with the coolant channel 15*c* in the base plate of the housing 3*a* of the plate heat exchanger 3. After flowing through the horizontally extending plate intermediate spaces 5 which route coolant, the coolant is then extracted via the coolant channels 15*a*, 16*a*, as is shown by way of the arrow 19 in FIG. 2B.

According to a further variant, the inlet opening 3*c* is then shown here in the region of a side wall of the housing 3*a* of the plate heat exchanger 3, via which inlet opening 3*c* the oil is aspirated into the prechamber 3*b*. Here too, a filter or screen element 3*e* which is shown here merely in highly diagrammatic illustration is once again inserted in the region of the inlet opening 3*c*.

Otherwise, the construction corresponds to that of FIG. 1B, with the result that reference is made to this with regard to the further construction.

It is to be mentioned expressly again at this point that all the invention variants and refinements, as have been described and shown in the individual figures, can of course be combined with one another in any desired way, for example the base side fixing of the plate heat exchanger with a refinement according to FIGS. 1A and 2A, to name only one example.

Figure 3:
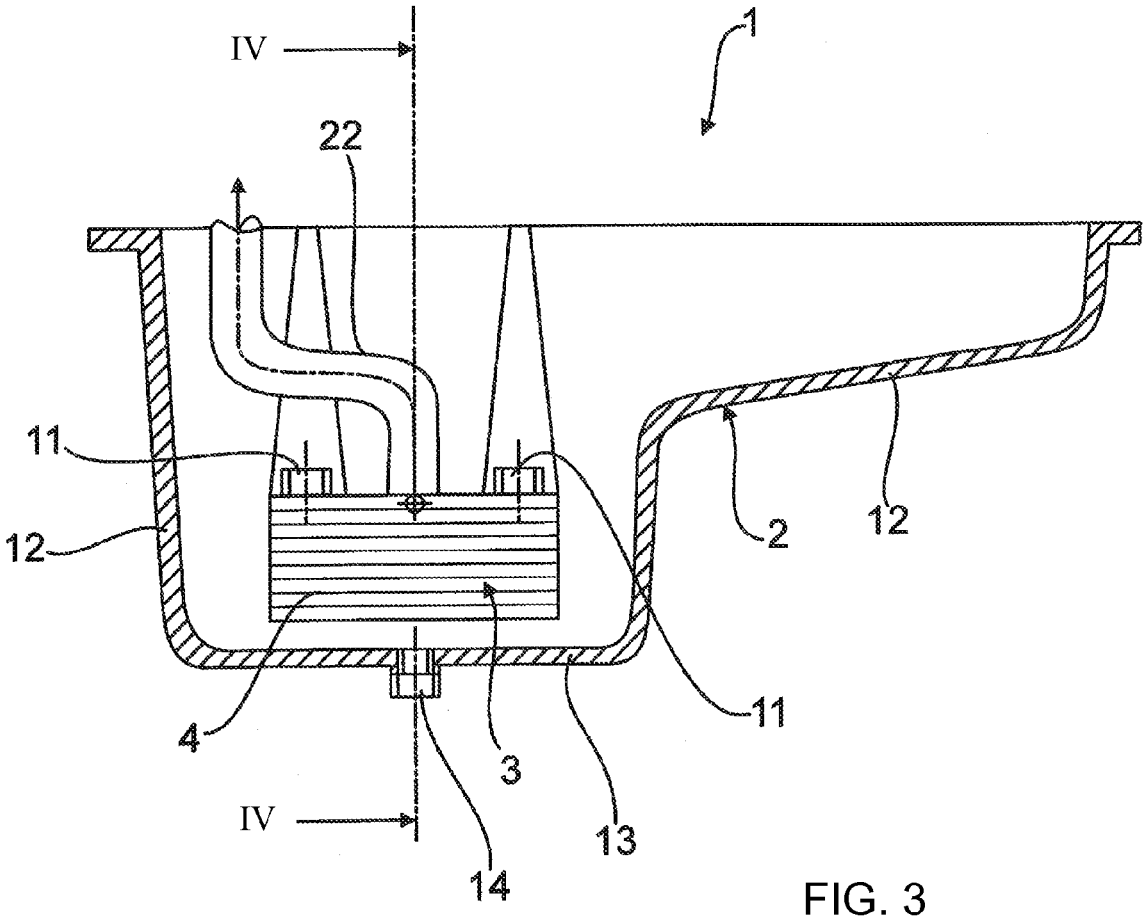
FIG. 3 diagrammatically shows a cross section through an oil trough with an alternative cooling device to the embodiment according to FIGS. 1 and 2.
Figure 4:
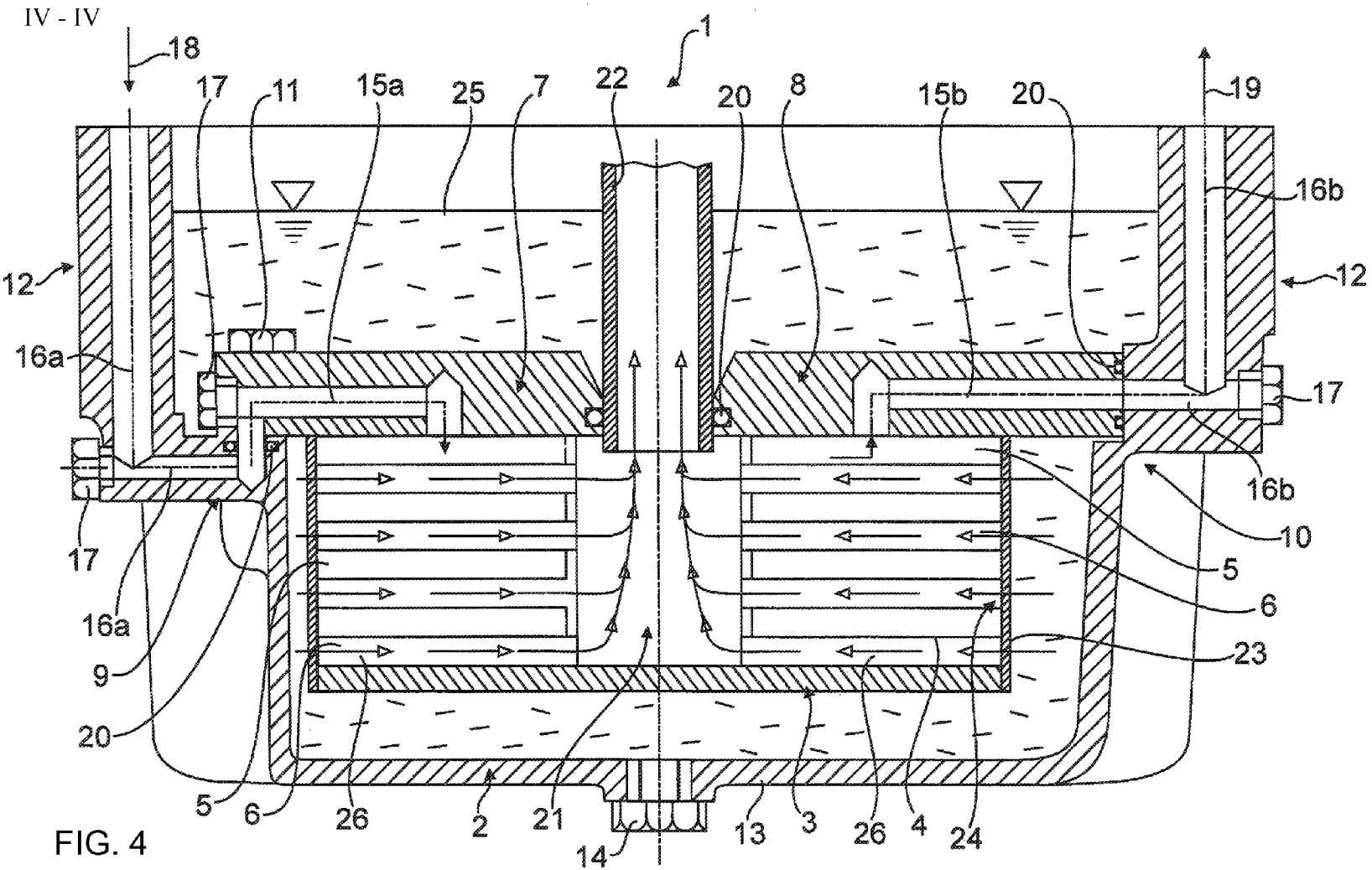
FIG. 4 shows a diagrammatic section along the line IV-IV of FIG. 3.

FIGS. 3 and 4 diagrammatically show different cross-sectional views through a further design variant of a cooling device 1. The cooling device 1 comprises a plate heat exchanger 3 which is received and arranged in an oil trough 2 as oil cooler.

With reference to FIG. 4, the plate heat exchanger 3 is formed, more specifically, by a plate assembly comprising a plurality of flat plates 4 which form firstly plate intermediate spaces 5 which route coolant and secondly plate intermediate spaces 6 which route oil.

The plate heat exchanger 3 is supported in such a way by means of bearing elements 7, 8 on the heat exchanger side on trough side supports 9, 10 and is fixed, for example, by means of screw connections 11, that the plate heat exchanger 3 is spaced apart both from the side walls 12 and from the base wall 13, in which an oil drain plug 14 is arranged in a usual way.

Here, coolant channels 15*a*, 15*b* which are produced by simple drilled holes and in turn communicate with coolant channels 16*a*, 16*b* which are integrated into the housing wall of the oil trough 2 and are likewise produced by simple drilled holes are integrated into the bearing elements 7, 8 on the heat exchanger side. In order to seal the coolant channel parts which extend horizontally in relation to the plane of the image of FIG. 4 and open into the outer wall, closure plugs or closure screws 17 are inserted into them. This also applies to the coolant channel 15*a* in the bearing element 7 on the left in the plane of the image of FIG. 4. As is shown using dash-dotted lines in FIG. 4, coolant can flow at the location where the arrow 18 is drawn into the housing side coolant channel 16*a*, from where it passes via the coolant channel 15*a* on the bearing element side into the plate intermediate spaces 5 which route coolant, before the coolant flows out according to the arrow 19 via the coolant channel 15*b* on the bearing element side and the coolant channel 16*b* on the housing side.

In order to seal the coolant channels 15, 16 with respect to one another, sealing elements 20 are arranged between the bearing element 7 and the bearing element 8 on one side and the housing side 9, 10 which are assigned to them.

Here, in the middle and centrally, the plate heat exchanger 3 has a recess 21 which forms a connecting region for a suction pipe line 22 which is guided to the oil pump (not shown here). This suction pipe line 22 is also sealed by means of sealing elements 20 with respect to the bearing elements 7, 8 on the heat exchanger side.

As can be gathered, furthermore, from the diagrammatic illustration of FIG. 4, the plate assembly of the plate heat exchanger 3 is enclosed radially circumferentially and therefore annularly by a cylindrical oil screen 23 in a positively locking manner.

As can be gathered from the illustration of FIG. 4, the respective plate intermediate spaces 6 which route oil are flow-connected with their radially outer opening regions 24 in each case directly to the oil 25 in the oil trough 2, with the result that the oil 25 is radially sucked directly out of the oil trough 2 via the oil screen 23 into the plate intermediate spaces 6 which route oil, with the result that the oil subsequently flows further in this radial direction to the central recess 21. Here, the thermal transfer occurs between the oil and the coolant in the plate intermediate spaces 5 which route coolant, to be precise, as can be seen from the illustration of FIG. 4, via relatively long flow paths. Starting from the recess 21, the cooled oil is then extracted via the suction pipe line 22. The oil flow is shown diagrammatically here by the arrows 26.

Figure 5:
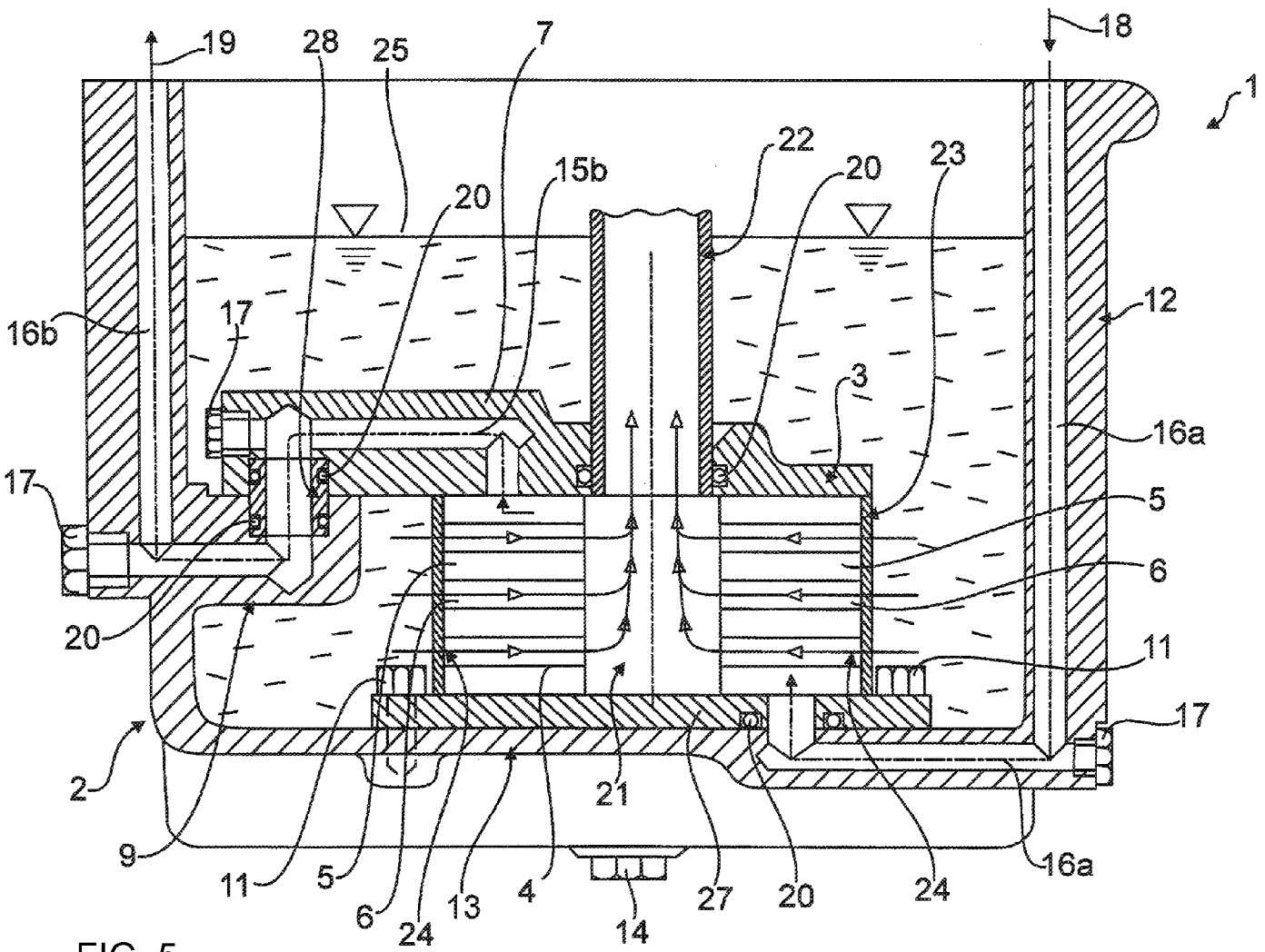
FIG. 5 diagrammatically shows a cross section through a further alternative embodiment of a cooling device.

Finally, FIG. 5 shows an alternative refinement to FIG. 4, in which alternative refinement identical components are provided with identical designations. In contrast to the refinement according to FIG. 4, the plate heat exchanger 3 is fastened here to the base wall 13 by means of screw connections 11. Furthermore, differences result with regard to the formation of the coolant channels. Thus, the coolant supply 18 takes place here via a coolant channel 16*a* on the housing wall side which, starting from the side wall 12, extends via the base wall 13 through a flange plate 27, by means of which the plate heat exchanger 3 is fixed to the base wall 13, to the plate heat exchanger 3 and there to the plate intermediate spaces 5 which route coolant. Here too, closure plugs 17 or sealing elements 20 are again provided at the corresponding locations.

In contrast, the coolant discharge according to the arrow 19 takes place via a coolant channel 16*b* which, starting from the housing wall of the oil trough 2, extends via an intermediate element 28 as far as a coolant channel 15*b* which is formed in a bearing element 7 on the heat exchanger side. The bearing element 7 is sealed with respect to the intermediate element 28 and the intermediate element 28 is sealed with respect to the housing wall by means of sealing elements 20.

Otherwise, the construction corresponds with regard to plate heat exchanger 3, plate intermediate spaces 5 which route coolant, plate intermediate spaces 6 which route oil, oil screen 23 and opening regions 24 once again to those of FIG. 4, with the result that reference is made to the comments with regard to FIG. 4 in order to avoid repetitions.

It goes without saying that merely the plate intermediate spaces 6 which guide oil are flow-connected to the oil 25 in the oil trough 2 via the opening regions 24. In other words, the coolant side and the oil side are separated sealingly from one another and merely a desired heat transfer takes place between the two media.

The invention claimed is:

1. A cooling device for engine and/or transmission oil cycling through an oil trough formed with oil trough walls, the cooling device comprising:

a plate heat exchanger forming an oil cooler in the oil trough, said plate heat exchanger being suspended in the oil trough from an upper wall at a defined spacing from the oil trough walls surrounding said plate heat exchanger;

said plate heat exchanger having plates disposed to form first plate intermediate spaces therebetween conducting a coolant flow therethrough and second plate intermediate spaces conducting the oil therethrough;

said second plate intermediate spaces having an outer opening region on an outer circumference of said plate heat exchanger, forming an inflow region for hot oil to be cooled to flow into said second plate intermediate spaces;

said second plate intermediate spaces having an outer outflow region on the outer circumference of said plate heat exchanger distally from said inflow region and connected indirectly or directly to an outer oil line connection, for cooled oil to flow out after traversing said second plate intermediate spaces and after exchanging heat with the coolant;

one or more attachment devices consisting of at least one heat exchanger bearing element fixing said plate heat exchanger on an oil trough side;

said at least one heat exchanger bearing element being an insert plate or a yoke plate or an insert plate integrated into a yoke plate; and wherein:

coolant channels, flow-connected to at least one part of said first plate intermediate spaces routing coolant, are formed integrated in said at least one heat exchanger bearing element;

said coolant channels connected to said first plate intermediate spaces are formed by coolant channels that are at least partially integrated into a housing wall of the oil trough;

said coolant channels that are integrated into said at least one heat exchanger bearing element are fluidically connected to at least one part of said coolant channels that are integrated into the housing wall of the oil trough; and said coolant channels are formed by a plurality of bores communicating with one another.

2. The cooling device according to claim 1, wherein said outer inflow region and said outer outflow region lie on opposite sides of said plate heat exchanger, as viewed in cross section through said plate heat exchanger.

3. The cooling device according to claim 1, wherein said plate heat exchanger comprises a heat exchanger housing, a plate assembly with a plurality of plates disposed in said heat exchanger housing, said heat exchanger housing is formed with an oil inlet opening, on a side of said inflow region, through which oil flows from the oil trough into said heat exchanger housing, and said heat exchanger housing is formed with an outlet opening, on an outflow side, through which oil flows out of said heat exchanger housing.

4. The cooling device according to claim 3, which further comprises a filter and/or screen assembly disposed to filter the oil flowing through said oil inlet opening.

5. The cooling device according to claim 3, wherein said housing is further formed with a prechamber or inflow chamber is disposed to receive the oil from said oil inlet opening and in front of the inflow region of said plate assembly.

6. The cooling device according to claim 5, wherein said oil inlet opening in said heat exchanger housing is formed to lie geodetically lower than said plate heat exchanger.

7. The cooling device according to claim 3, wherein said housing is further formed with an outflow chamber, into which the oil flows after flowing through said second plate intermediate spaces, and said outflow chamber has an oil outlet opening forming an oil line connecting region connected behind said outflow region of said plate assembly in said heat exchanger housing.

8. The cooling device according to claim 7, which comprises an oil line connected at said oil line connecting region or connected integrally to said oil line connecting region, and wherein said oil line is formed by a suction pipe line on an oil pump side.

9. The cooling device according to claim 1, wherein said plate heat exchanger is supported and/or clamped with said at least one heat exchanger bearing element between a plurality of oil trough housing walls.

10. The cooling device according to claim 1, wherein said plate heat exchanger is supported and/or clamped with said at least one heat exchanger bearing element between two mutually opposite oil trough housing walls.

11. The cooling device according to claim 1 configured for cooling the engine oil of an internal combustion engine.

12. The cooling device according to claim 1 configured for cooling the transmission fluid of a transmission associated with an internal combustion engine.

13. A cooling device for engine and/or transmission oil cycling through an oil trough, the oil trough being formed with oil trough side walls, an upper wall, and a substantially horizontal trough base wall, the cooling device comprising:

a plate heat exchanger forming an oil cooler in the oil trough, said plate heat exchanger being suspended in the oil trough from the upper wall at a defined spacing from the oil trough sidewalls laterally of said plate heat exchanger and at a defined spacing from the trough base wall;

said plate heat exchanger having plates disposed to form first plate intermediate spaces therebetween conducting a coolant flow therethrough and second plate intermediate spaces conducting the oil therethrough;

said second plate intermediate spaces having an outer opening region on an outer circumference of said plate heat exchanger, forming an inflow region for hot oil to be cooled to flow into said second plate intermediate spaces;

said second plate intermediate spaces having an outer outflow region on the outer circumference of said plate heat exchanger distally from said inflow region and connected indirectly or directly to an outer oil line connection, for cooled oil to flow out after traversing said second plate intermediate spaces and after exchanging heat with the coolant, one or more attachment devices consisting of at least one heat exchanger bearing element fixing said plate heat exchanger on an oil trough side;

said at least one heat exchanger bearing element being an insert plate or a yoke plate or an insert plate integrated into a yoke plate; and wherein:

coolant channels, flow-connected to at least one part of said first plate intermediate spaces routing coolant, are formed integrated in said at least one heat exchanger bearing element;

said coolant channels connected to said first plate intermediate spaces are formed by coolant channels that are at least partially integrated into a housing wall of the oil trough;

said coolant channels that are integrated into said at least one heat exchanger bearing element are fluidically connected to at least one part of said coolant channels that are integrated into the housing wall of the oil trough; and said coolant channels are formed by a plurality of bores communicating with one another.

* * * * *